US007607648B2

(12) United States Patent
Trovinger et al.

(10) Patent No.: US 7,607,648 B2
(45) Date of Patent: Oct. 27, 2009

(54) STAPLE HOLE FORMING APPARATUS

(75) Inventors: Steven W. Trovinger, Los Altos, CA (US); Ross R. Allen, St. Helena, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 601 days.

(21) Appl. No.: 11/290,953

(22) Filed: Nov. 30, 2005

(65) Prior Publication Data

US 2007/0122255 A1 May 31, 2007

(51) Int. Cl.
*B65H 37/04* (2006.01)

(52) U.S. Cl. ..... 270/37; 270/58.07; 270/58.08

(58) Field of Classification Search ..... 270/37, 270/58.07, 58.08; 227/181.1; 412/33
See application file for complete search history.

(56) References Cited

U.S. PATENT DOCUMENTS

| | | | | |
|---|---|---|---|---|
| 6,099,225 | A | 8/2000 | Allen et al. | |
| 6,550,756 | B2 | 4/2003 | Trovinger | |
| 6,554,267 | B2 | 4/2003 | Trovinger | |
| 6,578,838 | B2 | 6/2003 | Trovinger et al. | |
| 6,682,285 | B2 | 1/2004 | Trovinger et al. | |
| 6,708,967 | B1 | 3/2004 | Trovinger et al. | |
| 6,715,749 | B2 | 4/2004 | Trovinger | |
| 6,796,554 | B2 | 9/2004 | Trovinger | |
| 6,834,853 | B2 | 12/2004 | Trovinger et al. | |
| 7,236,737 | B2 * | 6/2007 | Mochizuki | 399/410 |
| 2002/0168247 | A1 | 11/2002 | Trovinger et al. | |
| 2003/0161704 | A1 | 8/2003 | Trovinger | |
| 2003/0161705 | A1 | 8/2003 | Trovinger | |
| 2003/0162644 | A1 | 8/2003 | Trovinger | |
| 2004/0052613 | A1 | 3/2004 | Trovinger | |
| 2004/0089999 | A1 | 5/2004 | Trovinger et al. | |
| 2004/0091336 | A1 | 5/2004 | Trovinger | |
| 2004/0094884 | A1 | 5/2004 | Trovinger et al. | |
| 2004/0094891 | A1 | 5/2004 | Trovinger et al. | |
| 2004/0175255 | A1 | 9/2004 | Trovinger et al. | |
| 2004/0188910 | A1 | 9/2004 | Trovinger et al. | |
| 2004/0239027 | A1 | 12/2004 | Trovinger et al. | |
| 2005/0056986 | A9 | 3/2005 | Trovinger et al. | |
| 2005/0152725 | A1 * | 7/2005 | Mochizuki | 399/410 |

FOREIGN PATENT DOCUMENTS

| | | |
|---|---|---|
| EP | 0992 365 A1 | 4/2000 |
| WO | WO 00/18583 | 4/2000 |

* cited by examiner

*Primary Examiner*—Gene Crawford
*Assistant Examiner*—Leslie A Nicholson, III

(57) ABSTRACT

A staple hole forming apparatus including a pair of pins and a pin receptor. The pair of pins are spaced from each other a distance substantially equal to a distance between two legs of a staple. The pin receptor is positioned opposite the pair of pins relative to a sheet path through the staple hole forming apparatus. The pin receptor is positioned to mate with at least one of the pair of pins. One of the pair of pins and the pin receptor is configured to move towards and mate with the other of the pair of pins and the pin receptor causing the pair of pins to penetrate a sheet extending between the pair of pins and the pin receptor to form two holes in the sheet. Each of the two holes is configured to receive one of the two legs of the staple.

12 Claims, 9 Drawing Sheets

STAPLE HOLE FORMING APPARATUS

BACKGROUND

Electronic document publishing often demands more than a stack of paper in an output tray of an office printer. Typically, a plurality of duplex printed sheets are bound into finished documents by a publishing system that prints and finishes books. Publishing systems perform operations such as collating, binding, folding, trimming, stapling, etc. These finishing operations are typically performed on all of the sheets in a book at one time, which generally requires the use of high forces and powerful motors. Consequently, the systems adapted to perform these functions are relatively expensive and often exceed the cost of other desktop or office printers. As such, known publishing systems are not generally well suited for use in low-cost desktop bookmaking.

Other typical publishing systems incorporate sheet-wise operations, which are performed on individual sheets that are subsequently accumulated or stacked and bound to form a bound document. However, since the entire stack of sheets must generally be accumulated before being stapled or otherwise bound, conventional finishing systems utilize high-force staplers configured to staple through an entire sheet stack in a single operation. More particularly, typical staplers require a high mechanical force to press staple legs through the sheet stack and bend the staple legs to bind the sheet stack. Since the sheet fibers are forced aside to allow passage of the staple legs, the required force to staple a document is relatively large and increases as the number of sheets in the sheet stack increases. Therefore, a need exists for a publishing system that decreases forces and motor power used to staple a bound document while providing a compact system suitable for use with office printers and for methods associated therewith.

SUMMARY

One aspect of the present invention relates to a staple hole forming apparatus configured to facilitate binding a plurality of sheets with a staple having two legs. The staple hole forming apparatus includes a pair of pins and a pin receptor. The pair of pins are spaced from each other a distance substantially equal to a distance between the two legs of the staple. The pin receptor is positioned opposite the pair of pins relative to a sheet path through the staple hole forming apparatus. The pin receptor is positioned to mate with at least one of the pair of pins. One of the pair of pins and the pin receptor is configured to move towards and mate with the other of the pair of pins and the pin receptor causing the pair of pins to penetrate a sheet extending between the pair of pins and the pin receptor to form two holes in the sheet. Each of the two holes is configured to receive one of the two legs of the staple.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "down," "over," "above," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Figure 1:
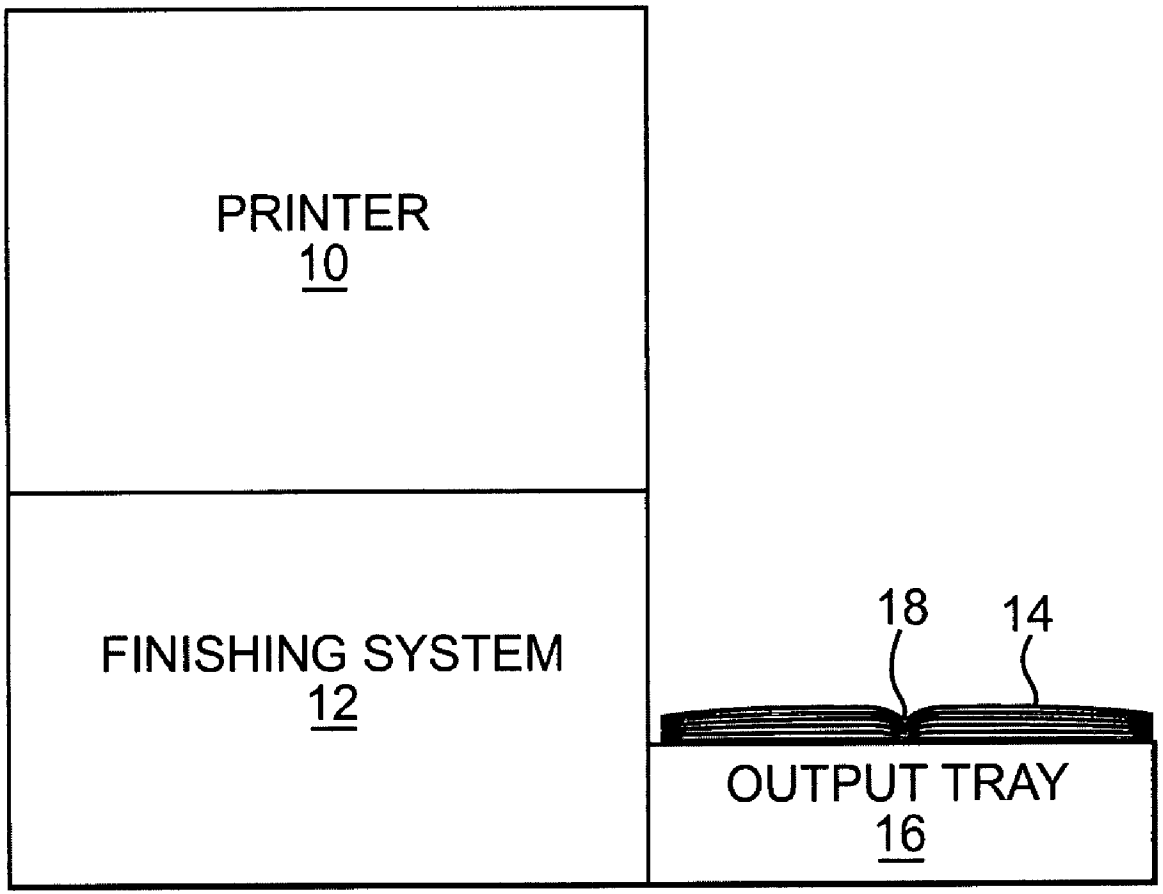
FIG. 1 is block diagram illustrating one embodiment of a printer and a finishing system suitable for use in forming bound documents.

FIG. 1 is a block diagram illustrating one embodiment of a printer 10 and a finishing system 12 suitable for use in forming bound documents or booklets as part of a low-cost system configured to produce finished documents in the electronic publishing environment. In one embodiment, printer 10 prints a plurality of sheets which are fed to finishing system 12 for folding, collating, binding, and performing other finishing operations, if any. Finishing system 12 outputs bound document 14 to an output tray 16 where bound document 14 is accessible by a user.

In one embodiment, bound document 14 is stapled along a spine 18 within finishing system 12 in a two part process to reduce the mechanical forces required for the stapling operation. In particular, in a first step, staple holes are punched, drilled, or otherwise formed in each sheet. In a subsequent step, the sheets are accumulated into a sheet stack, and the legs of the staples are inserted through the existing staple holes. The staples are secured about the sheet stack to form bound document 14. Accordingly, lower forces are utilized as compared to a single step stapling method, in which holes are formed in a sheet stack concurrently with the insertion of the staple legs through the sheet stack. The need for and use of reduced mechanical forces permits use of lower cost drives, motors, and overall system structure, which decreases the overall cost of finishing system 12. In addition, since lower forces can be used, the sheet capacity for bound documents may also increased. It should be noted that although primarily described herein as a sheet-wise operation forming staple holes in single sheets of bound document 14, in other embodiments, staple holes are simultaneously formed in more than one sheet at a time. Staple holes may be formed in any number of the plurality of sheets of to be included in bound document 14, including more than one sheet and up to all the sheets for bound document 14. In one embodiment, the number of sheets 20 is less than all of the sheets to be included in bound document 14.

Figure 2:
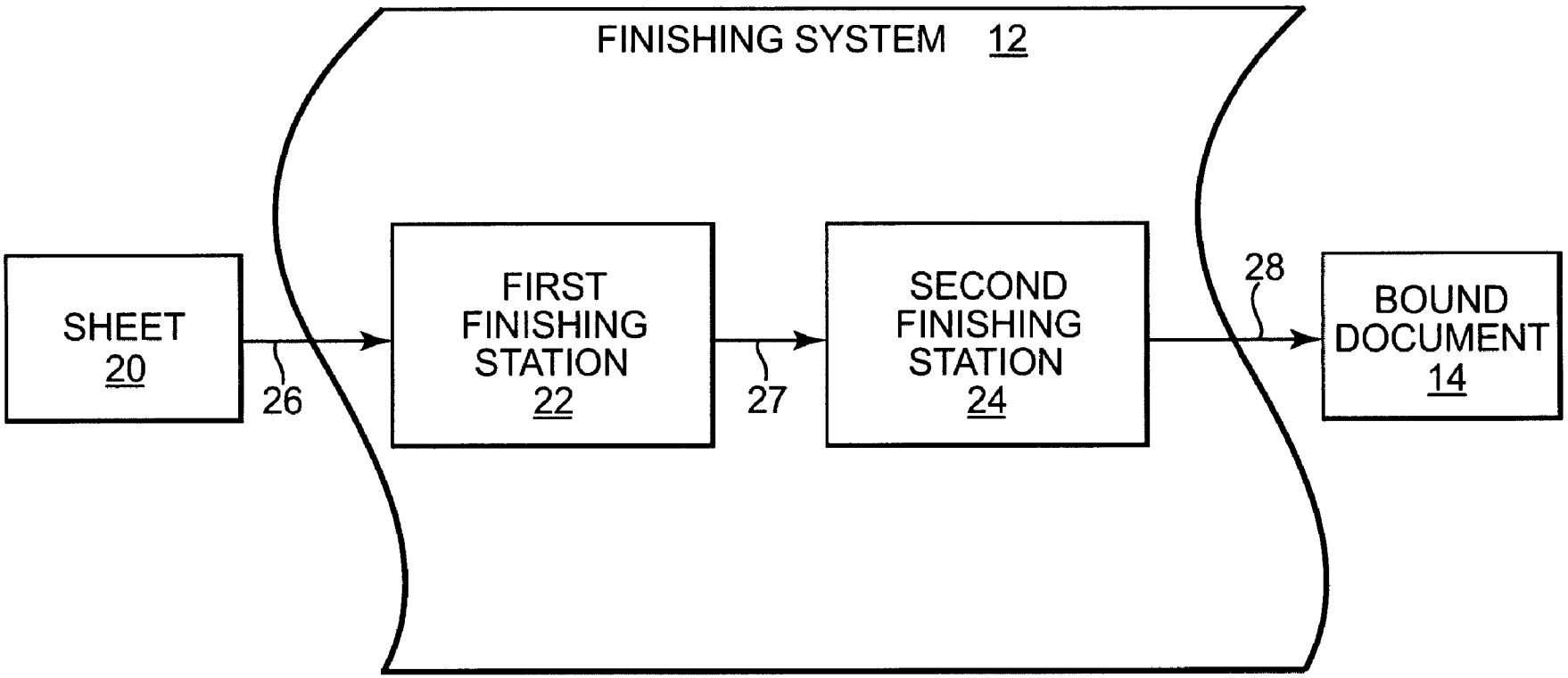
FIG. 2 is a schematic diagram illustrating one embodiment of a portion of the finishing system of FIG. 1 and a media path therethrough.

FIG. 2 is a schematic diagram illustrating one embodiment of a path of a sheet 20 of print media through at least a portion of finishing system 12. In one embodiment, finishing system 12 includes a plurality of finishing stations, including, for example, a first finishing station 22 and a second finishing station 24. In one embodiment, first finishing station 22 is configured to form staple holes in individual ones or more than one of sheets 20, and second finishing station 24 is configured to accumulate and bind the sheets 20 to form bound document 14. In one embodiment, first station 22 is also configured to fold each sheet 20.

During use and as indicated by arrow 26, one or more sheets 20 are received from printer 10 (illustrated in FIG. 1) or another finishing station within finishing system 12 and fed to first finishing station 22. After being processed at first finishing station 22 and as indicated by arrow 27, each sheet 20 continues along the media path to second finishing station 24. In one embodiment, a plurality of sheets 20 are accumulated and bound or processed at second finishing station 24. As generally indicated by exit arrow 28, the plurality of sheets 20 exit second finishing station 24 as bound document 14. In one embodiment, bound document 14 is fed from second finishing station 24 to another finishing station, such as a trimming station, or to output tray 16 (illustrated in FIG. 1).

Figure 3A:
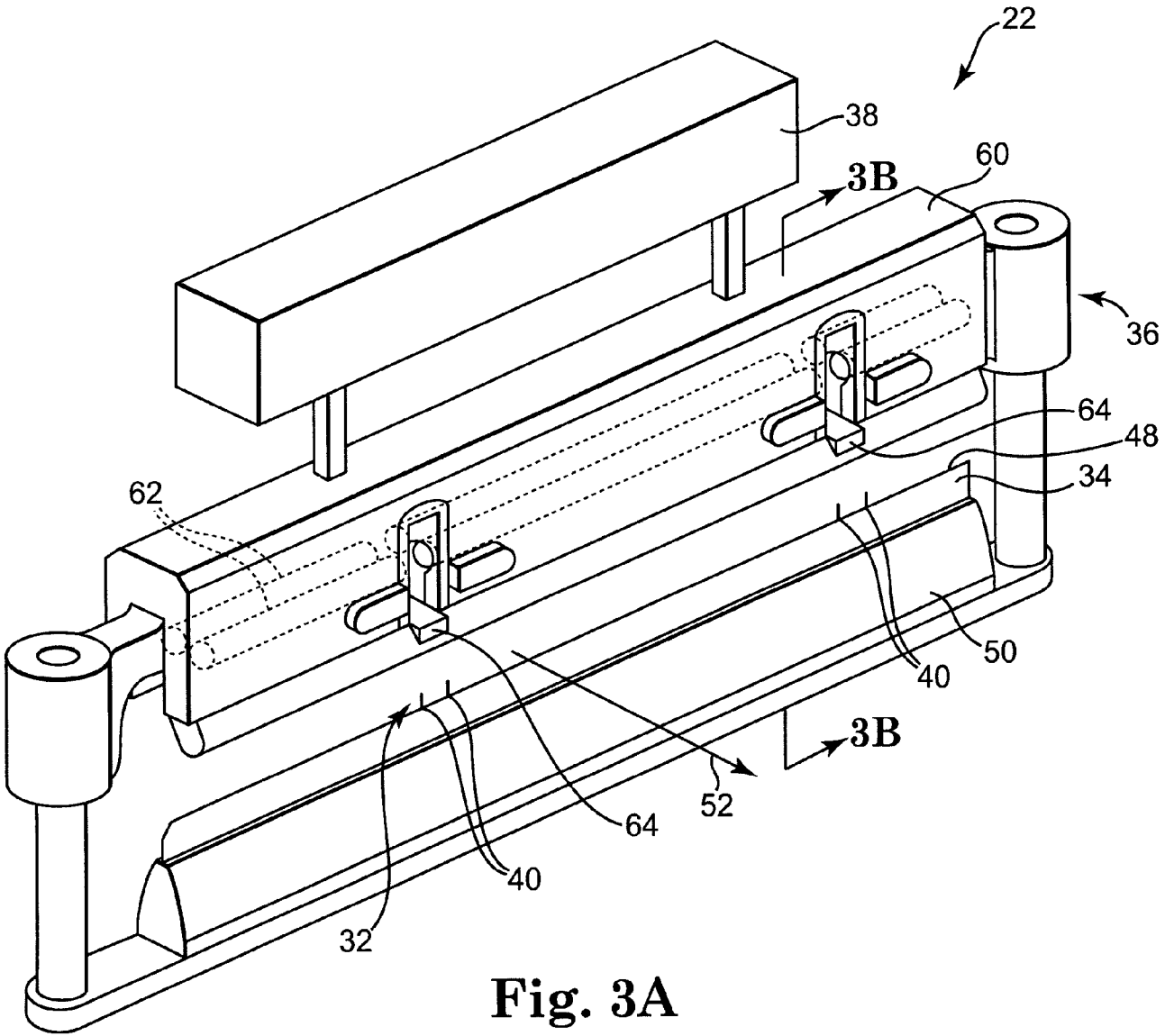
FIG. 3A is a perspective view of one embodiment of a finishing station of the finishing system of FIG. 2.
Figure 3B:
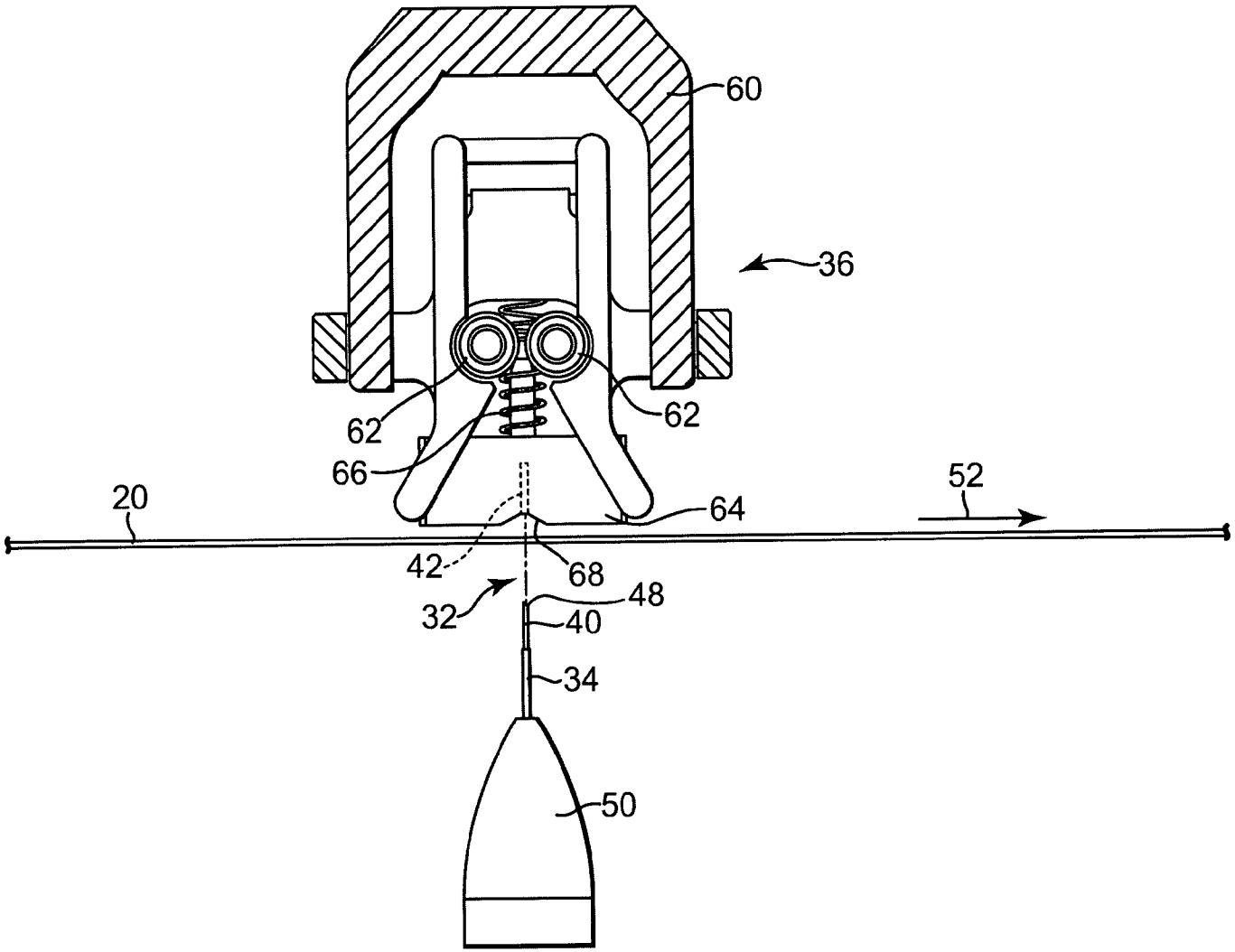
FIG. 3B is a cross-sectional view of FIG. 3A taken along the line 3B-3B and including a media sheet.

FIGS. 3A and 3B collectively illustrate one embodiment of first finishing station 22. First finishing station 22 is configured to form staple holes in sheets 20. In one embodiment, first finishing station 22 is additionally configured to fold sheets 20 to form spine 18. In particular, in one embodiment, first finishing station 22 is substantially similar to the sheet folding apparatus disclosed in U.S. Pat. No. 6,855,101 to Trovinger et al., which is hereby incorporated by reference in its entirety, with the addition of a punch apparatus 32 or other staple hole forming apparatus as will be further described below.

In one embodiment, first finishing station 22 includes a fold blade 34, a carriage assembly 36, and a drive mechanism 38. Drive mechanism 38 is configured to move carriage assembly 36 toward fold blade 34 to fold and form holes in one or more sheets 20 (illustrated in FIG. 3B) positioned between fold blade 34 and carriage assembly 36. In one embodiment, fold blade 34 and carriage assembly 36 collectively define punch apparatus 32 including pins 40 and pin receptors 42 (illustrated in FIG. 3B). Punch apparatus 32 is configured such that when carriage assembly 36 moves towards fold blade 34, pins 40 penetrate one or more sheets 20 positioned between fold blade 34 and carriage assembly 36 to form at least one pair of staple holes through the sheet(s) 20.

In one embodiment, fold blade 34 is made of metal or any other suitable material and is shaped as a substantially flat strip having a generally rectangular cross-sectional profile at its free edge 48. In other embodiments, fold blade 34 is formed having other cross-sectional profiles, such as a rounded, triangular, concave, or convex cross-sectional profile. In one embodiment, fold blade 34 is supported by a blade holder 50 and laterally extends in a direction substantially perpendicular to the longitudinal sheet path, which is generally indicated by arrow 52. In one embodiment, fold blade 34 is alternatively held by any other stabilizing structure or is manufactured with blade holder 50 as a unitary component.

Carriage assembly 36 extends substantially parallel to and above fold blade 34 Carriage assembly 36 is coupled with drive mechanism 38. Drive mechanism 38 is configured to selectively move carriage assembly 36 toward fold blade 34. In another embodiment, carriage assembly 36 is substantially stationary and fold blade 34 alternatively moves towards carriage assembly 36.

In one embodiment, carriage assembly 36 includes a housing 60, fold rollers 62, and one or more pinch foot 64. Housing 60 is configured to retain fold rollers 62 and at least one pinch foot 64 and is coupled with drive mechanism 38. In one embodiment, housing 60 extends parallel to fold blade 34 and is made of any suitable material, such as metal or plastic.

Fold rollers 62 are rotatably attached to an interior portion of housing 60. At least two sets of parallel fold rollers 62 are included in the embodiment of carriage assembly 36 illustrated in FIGS. 3A and 3B. However, in other embodiments any number of fold rollers 62 may be utilized. Each fold roller 62 rotates about an axis parallel to the lateral extension of fold blade 34 and is biased toward an opposing fold roller 62. Fold rollers 62 are positioned relative to fold blade 34 such that when moved toward fold blade 34, fold blade 34 is positioned in a plane which passes between fold rollers 62. In one embodiment, no fold rollers 62 are included in carriage assembly 36. In one embodiment, carriage assembly 36 includes additional or other means for forcing sheet 20 around fold blade 34 to form a fold line in sheet 20.

Each pinch foot 64 is configured to clamp against fold blade 34, and is resiliently mounted to an internal portion of housing 60. For example, each pinch foot 64 is attached to housing 60 with a pinch spring 66 as illustrated in FIG. 3B. However, use of any other suitable resilient attaching means is also contemplated to attach each pinch foot 64 to housing 60. Each pinch foot 64 is made of any suitable material, such as metal, plastic, etc. In one embodiment, one or more pinch foot 64 is formed of a substantially rigid or non-deformable material. In another embodiment, one or more pinch foot 64 is formed of a deformable or resilient material. In one embodiment, two or more pinch feet 64 are included within housing 60 spaced laterally apart from one another. In one embodiment, each pinch foot 64 is configured to correspond with the lateral positioning of each pair of pins 40 along fold blade 34.

As illustrated in FIG. 3B, in one embodiment, each pinch foot 64 defines a pinch groove 68 configured to locate and hold sheet 20 against fold blade 34. In one embodiment, pinch groove 68 has an inverted-V cross-section shape. However, in other embodiments, pinch groove 68 is formed with any other suitable cross-section shape configured to correspond with the cross-sectional shape of fold blade 34.

In one embodiment, each pinch foot 64 defines one or more pin receptor 42. Each pin receptor 42 is a void or other area extending from pinch groove 68 in a substantially linear direction relative to and away from fold blade 34. In one embodiment, each pin receptor 42 extends in a direction substantially parallel to and in line with the extension of fold blade 34 from blade holder 50. Each pin receptor 42 is positioned to laterally and longitudinally align with at least one corresponding pin 40. Accordingly, as carriage assembly 36 is moved toward fold blade 34, each pin receptor 42 receives at least one corresponding pin 40.

In one embodiment, punch apparatus 32 is collectively formed by fold blade 34 and carriage assembly 36, and includes male portions or pins 40 and female portions or pin receptors 42. In one embodiment, pins 40 extend from fold blade 34 toward carriage assembly 36. Pins 40 are each any suitable pin or die configured to punch or otherwise form a hole in one or more sheets 20. More particularly, in one embodiment, each pin 40 is generally cylindrical with a pointed tip. However, use of pins having other cross-sectional shapes are also contemplated. Pins 40 are each formed of a relatively rigid material, such as metal. In one embodiment, pins 40 have a cross-sectional size substantially the same as a cross-sectional size of the staple legs intended to be inserted through holes formed by pins 40. In one embodiment, pins 40 have a cross-sectional size smaller than a cross-sectional size of the staple legs intended to be inserted through holes formed by pins 40. In one embodiment, pins 40 have a cross-sectional size larger than a cross-sectional size of the staple legs intended to be inserted through holes formed by pins 40.

In one embodiment, pins 40 are arranged into at least one pair of pins 40. Each pair of pins 40 is configured to form a pair of staple holes in sheet 20 configured to receive opposing legs of a staple. Accordingly, pins 40 defining a pair of pins 40 are spaced from each other a distance substantially equal to a distance between the two legs of a staple. In one embodiment, more than one staple is used to bind the document, such that more than one pair of pins 40 are used to form staple holes. When more than one pair of pins 40 are used to form staple holes, each pair of pins 40 is spaced from other pairs of pins 40 a distance substantially equal to a distance desired for spacing staples along a spine 18 of bound document 14 (illustrated in FIG. 1). In one embodiment, the position of pins 40 and/or pin receptors 42 are adjustable along and over fold blade 34, such that the position of any holes 78 in sheets 20 can be adjusted dependent upon the desired characteristics of bound document 14. In one embodiment, more pin receptors 42 than pins 40 are included wherein each pin receptor 42 corresponds with a different available position for one of pins 40.

Once again referring to FIG. 3A, during use of first finishing station 22, drive mechanism 38 is configured to move carriage assembly 36 toward sheet 20 and fold blade 34. As carriage assembly 36 is moved toward fold blade 34, sheet 20 is clamped and secured between fold blade 34 and each pinch foot 64. In one embodiment, as each pinch foot 64 engages and interacts with sheet 20 over fold blade 34, each pin 40 penetrates sheet 20 and mates with and/or extends into a corresponding pin receptor 42. Accordingly, movement of carriage assembly 36 towards fold blade 34 moves pins 40 and pin receptor 42 between an unmated position and a mated position. In this respect, a hole corresponding to each pin 40 is formed in sheet 20.

In one embodiment, as carriage assembly 36 progresses further toward fold blade 34, each pinch foot 64 is forced back into housing 60 against springs 66, while maintaining pressure on sheet 20 against fold blade 34 due to the action of pinch springs 66. In one embodiment, when sheet 20 is clamped between fold blade 34 and pinch grooves 68, sheet 20 is secured relative to first finishing station 22 to define a fold position and to ensure proper alignment of sheet 20 relative to fold blade 34.

In one embodiment, a fold line is formed in sheet 20 by moving fold rollers 62 relative to fold blade 34 such that fold blade 34 and sheet 20 pass between fold rollers 62. For example, housing 60 moves toward fold blade 34 such that sheet 20 is deformed between fold blade 34 and opposing fold rollers 62 to fold sheet 20. In one embodiment, fold rollers 62 are biased toward each other with the use of any springs or other bias mechanism or material. By pressing and rolling fold rollers 62 against sheet 20 and fold blade 34, a portion of sheet 20 conforms to the shape of fold blade 34 and thus the fold is defined in sheet 20.

Upon folding sheet 20, drive mechanism 38 or other biasing force moves carriage assembly 36 away from fold blade 34, which also rolls fold rollers 62 away from fold blade 34. Therefore, each pinch foot 64 with pin receptors 42 is translated away from fold blade 34, pins 40, and sheet 20 (i.e., punch assembly 32 is transitioned from the mated position back to the unmated position). Although described above as translating carriage assembly 36 relative to fold blade 34, in other embodiments, fold blade 34 is alternatively translated relative to carriage assembly 36 to fold and punch holes in sheet 20.

Figure 4A:
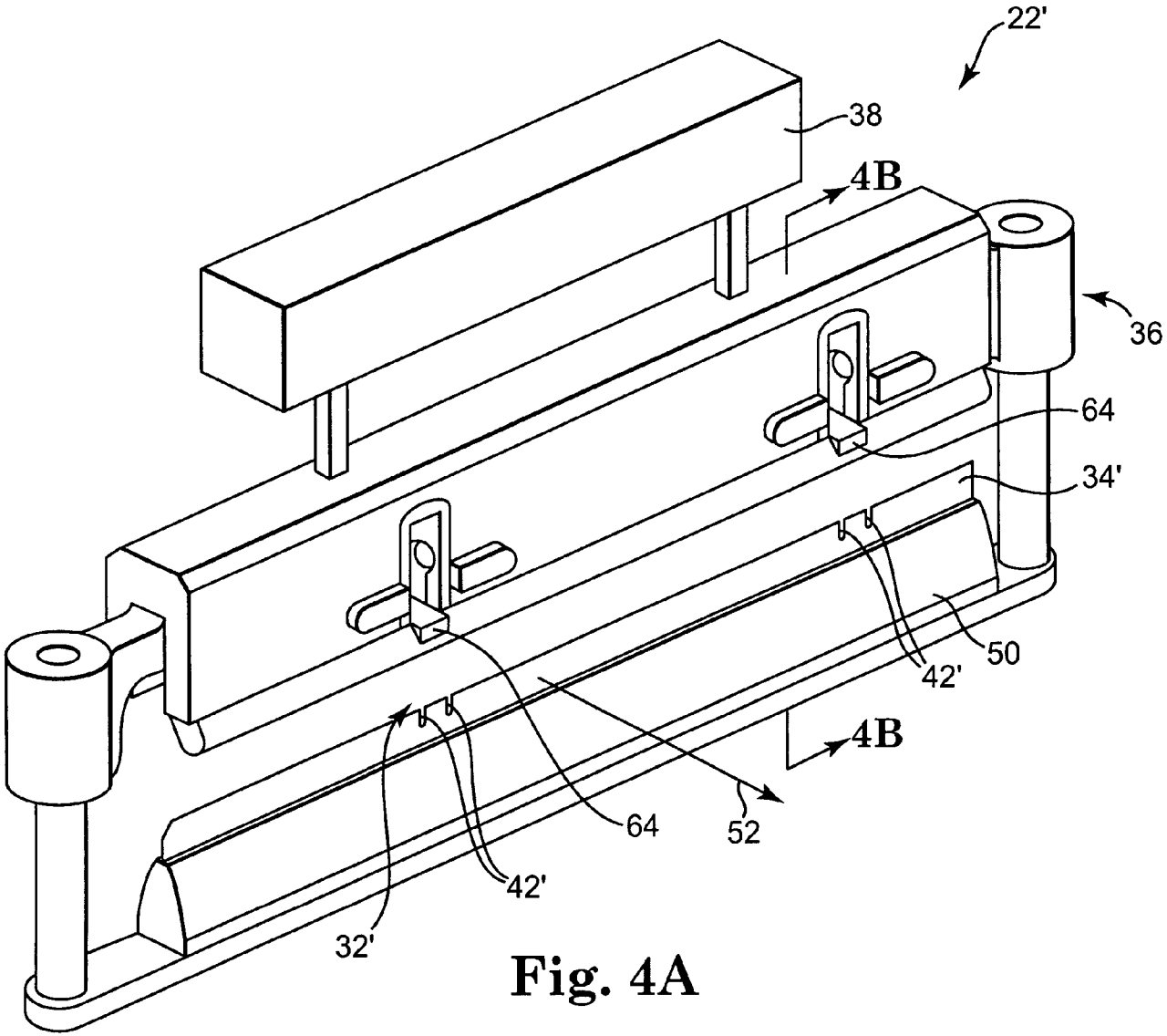
FIG. 4A is a perspective view of one embodiment of a finishing station of the finishing system of FIG. 2.
Figure 4B:
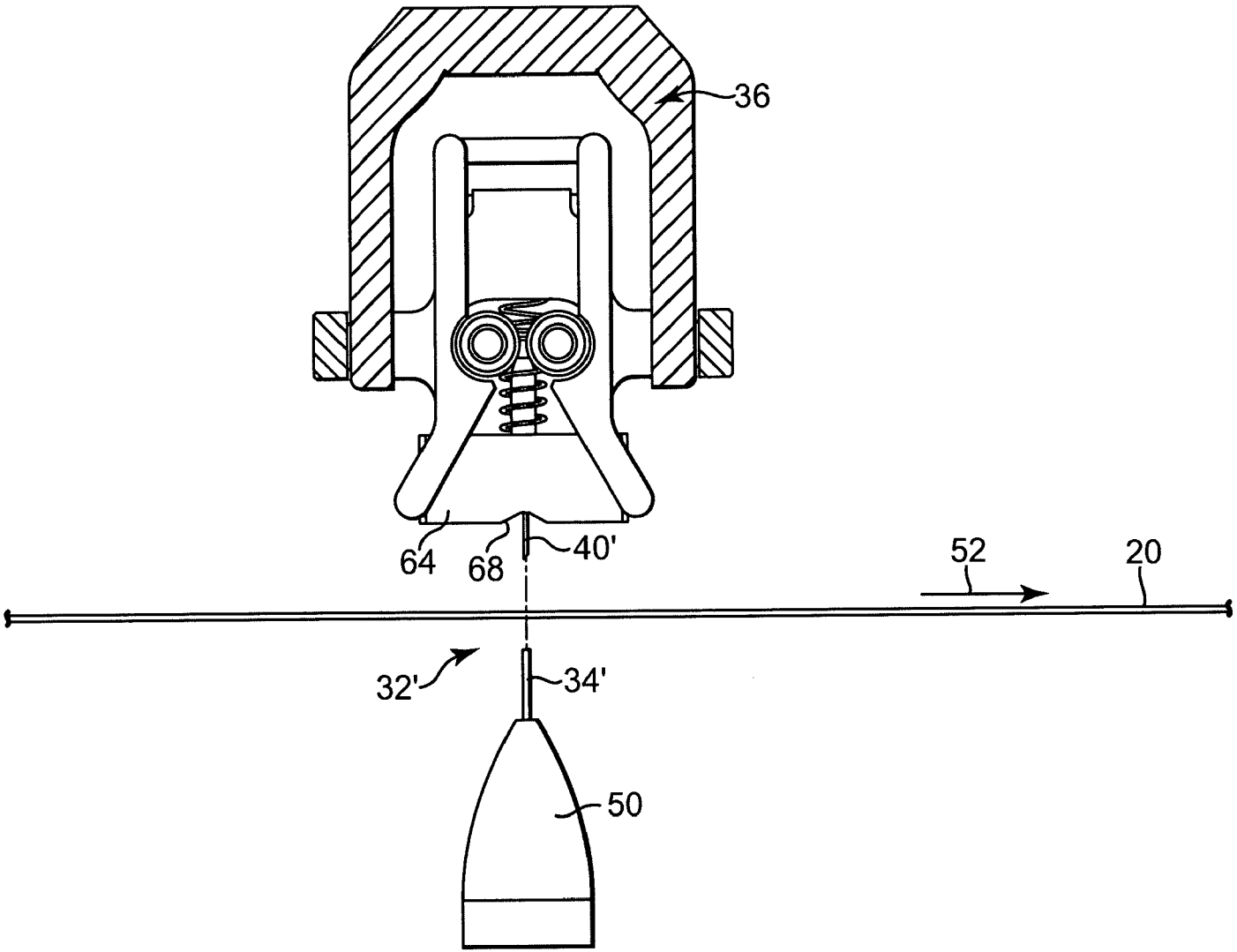
FIG. 4B is a cross-sectional view of FIG. 4A taken along the line 4B-4B and including a media sheet.

FIGS. 4A and 4B collectively illustrate another embodiment of a first finishing station 22' with a punch apparatus 32'. First finishing station 22' is substantially similar to first finishing station 22 described above except for those differences enumerated herein. Punch apparatus 32' includes pins 40' (illustrated in FIG. 4B) and pin receptors 42'. A pair of pins 40' extends from pinch groove 68 of a pinch foot 64 toward fold blade 34'. Pins 40' are substantially similar to pins 40 described above. Pin receptors 42' are formed as breaks or other reception areas in fold blade 34'. First finishing station 22' functions similar to first finishing station 22, with only the positioning of pins 40' and pin receptors 42' being reversed. Accordingly, as carriage assembly 36 moves toward fold blade 34, pin receptors 42' receive corresponding pins 40'.

In one embodiment, the position of pins 40' and/or pin receptors 42' are adjustable along and over fold blade 34', such that the position of any holes 78 in sheets 20 can be adjusted dependent upon the desired characteristics of bound document 14. In one embodiment, more pin receptors 42' are formed in fold blade 34' as compared to the number of pins 40' included in first finishing system 22' where each pin receptor 42' corresponds with a different available position for a pin 40'.

Although the use and methods are described herein primarily with respect to first finishing system 22, it will be understood that first finishing station 22' or other suitable devices, such as a hole drilling apparatus, may additionally or alternatively be used to form staple holes in sheet 20.

Figure 5:
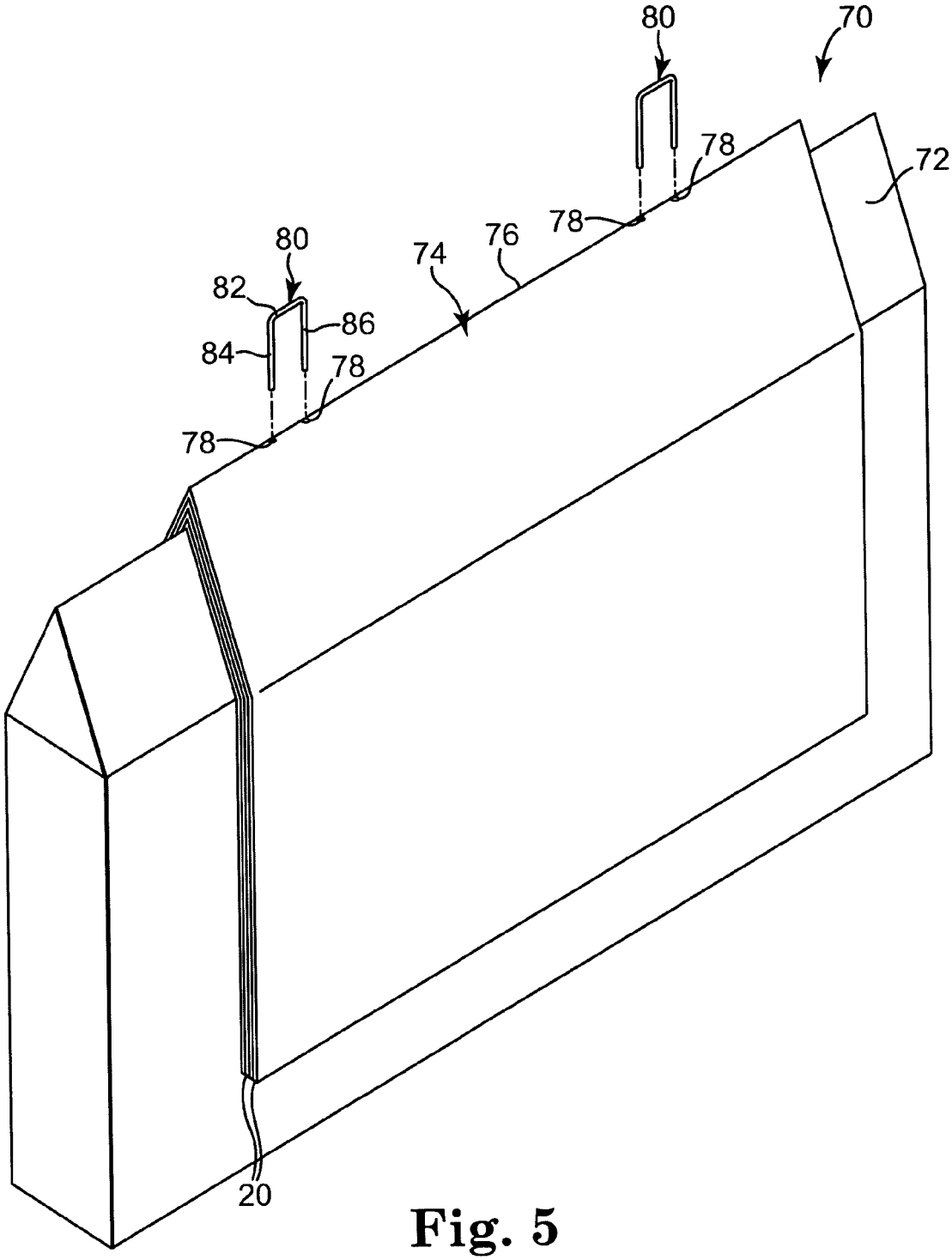
FIG. 5 is a perspective view of one embodiment of a binding station of finishing system of FIG. 1.

As generally illustrated in FIG. 2, in one embodiment, following punching of holes and folding of sheet(s) 20 at first finishing station 22, the sheet(s) 20 are forwarded along sheet path 52 to second finishing station 24, which in one embodiment, includes a staple apparatus configured to accumulate and bind a plurality of sheets 20. For example, FIG. 5 illustrates one embodiment of a staple apparatus 70. Staple apparatus 70 includes a saddle or other sheet support 72 configured to receive each of the plurality of sheets 20 from first finishing station 22 (illustrated in FIG. 2) to form a sheet stack 74. The plurality of sheets 20, which have been folded and punched to define a fold line 76 and staple holes 78 at first finishing station 22, are positioned on saddle 72 in a jogged or aligned manner such one or more sheet edges, fold lines 76, and/or the plurality of staple holes 78 formed in each of sheets 20 align with one another.

Once all of sheets 20 have been accumulated, the legs of staples 80 are inserted through each pair of staple holes 78. In particular, as illustrated, in one embodiment, each staple 80 includes a cross member 82, a first leg 84, and a second leg 86. Legs 84 and 86 extend from opposite ends of cross member 82 in a substantially perpendicular manner. In one embodiment, staples 80 are metal staples. Each staple 80 is positioned relative to staple holes 78 such that first leg 84 is positioned to align with one staple hole 78 and second leg 86 is positioned to align with a second staple hole 78. Staples 80 are inserted through sheet stack 74 in any suitable method such as, for example, with a conventional power or manual stapler. More particularly, legs 84 and 86 are inserted to extend through each of the corresponding staple holes 78 in sheet stack 74, and upon insertion, each staple 80 interacts with staple saddle 72.

Upon interaction with staple saddle 72, which is generally a rigid material such as metal or other material sufficiently rigid to deform staple legs 84 and 86, each staple leg 84 or 86 is bent or otherwise deformed to clasp the innermost sheet 20 of sheet stack 74, thereby, securing staple 80 to sheets 20 and binding document 14. Although described above with respect to FIGS. 3A, 4A, and 5 as forming two pairs of staple holes 78 in each sheet 20 and inserting two staples 80 through sheet stack 74, in one embodiment, one, three, or any other number of staple hole pairs or staples may be formed and inserted into sheet stack 74 as desired for a particular bound document 14. Accordingly, any suitable number of pins 40 and pin receptors 42 may be utilized in first finishing station 22.

Since staple holes 78 are formed in an operation separate from the insertion of staples 80, the overall forces utilized to insert legs 84 and 86 through sheets 20 to bind document 14 are significantly diminished. In particular, since staple holes 78 are formed in individual ones or portions of sheets 20, less force is required to form holes 78 than is required to punch holes through the entire sheet stack 74 at one time as in conventional systems. Such insertion forces are substantially less than the force required in conventional finishing systems to concurrently punch holes through a sheet stack, position the staple legs through the sheet stack, and to deform the staple legs to bind the sheet stack. Use of reduced forces permits use of lower cost drives, motors, and overall system structure, which decreases the overall cost of finishing system 12. In addition, since lower forces can be used, the sheet capacity for bound documents may also increased. Use of reduced overall forces also permits a wider range of sheet types to be used to form bound document 14. For example, thicker sheets or coated sheets, such as photo paper, etc., can be bound within finishing system 12 without generally requiring the relatively large forces typically used to bind such sheet types.

As generally indicated by exit arrow 28, once sheets 20 are stapled, the plurality of sheets 20 exit second finishing station 24 as bound document 14. In one embodiment, bound document 14 exiting second finishing station 24 is forwarded to another finishing station or output tray 16 (illustrated in FIG. 1). In one embodiment, bound document 14 is forwarded from second finishing station 24 to a trimming station.

Figure 6:
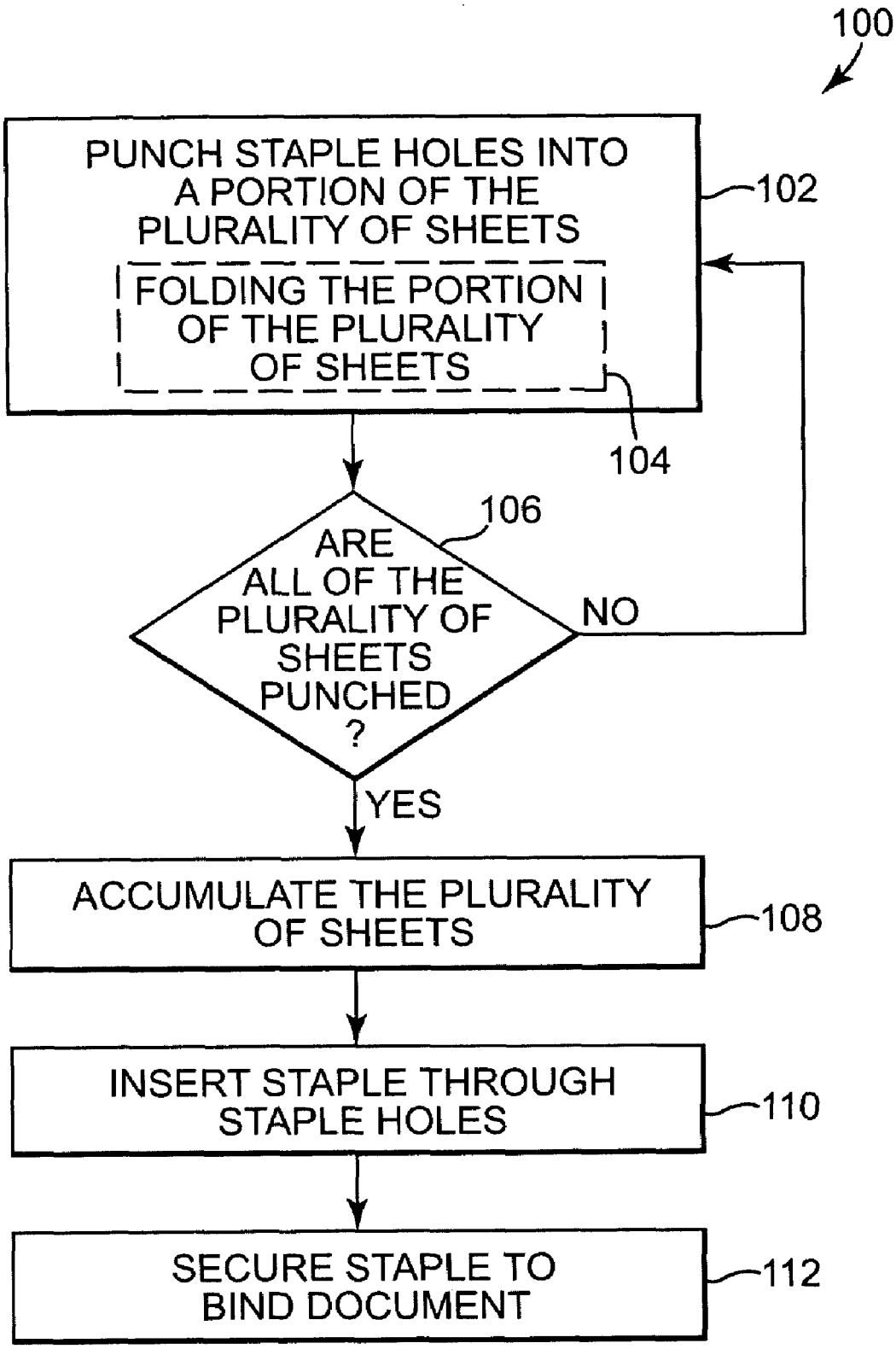
FIG. 6 is a flow chart illustrating one embodiment of a method of binding a document.

FIG. 6 generally illustrates one embodiment of a method of forming a bound document at 100 and is described as being performed by finishing station 12 with additional reference to FIGS. 2 and 3A. At operation 102, a portion of sheets 20 is positioned within first finishing station 22 between fold blade 34 and carriage assembly 36. Carriage assembly 36 is moved toward fold blade 34 to form staple holes 78 in the portion of sheets 20. In one embodiment, as indicated at operation 104, the portion of sheets 20 is optionally folded in the same operation that staple holes 78 are punched.

At operation 106, it is determined if all sheets 20 to be included in bound document 14 have been punched with staple holes 78. If all sheets 20 have not been punched, operation 102 is repeated as needed until all sheets 20 have been punched. If all sheets 20 have been punched, method 100 continues to operation 108. In one embodiment, it is desired that less than all of sheets 20 are punched prior to insertion of staples 80 (illustrated in FIG. 5). For example, in one embodiment, only a portion of sheets 20, such as every other sheet 20, etc., are punched to lessen the forces required to subsequently staple the plurality of sheets 20. In such an embodiment, in operation 106 it is determined if the desired number of sheets 20 have been punched.

Additionally referring to FIGS. 2 and 5, at operation 108, the portion of sheets 20 exit the first finishing station 22 and is forwarded to second finishing station 24 to be accumulated into a sheet stack 74. In one embodiment, a portion of sheets 20 are periodically received from first finishing station 22 and are accumulated on staple saddle 72 to form sheet stack 74. Accumulating sheets 20 includes jogging or otherwise aligning the plurality of sheets 20 on saddle 72 such that the sheet edges, fold lines 76, and/or staple holes 78 of each sheet 20 aligns with the sheet edges, fold lines 76, and/or staple holes 78 of the other sheets 20 of sheet stack 74.

At operation 110, staples 80 are inserted through staple holes 78 as previously described with respect to FIG. 5. In particular, legs 84 and 86 are inserted through sheet stack 74 via corresponding staple holes 78. At operation 112, staples legs 84 and 86 contact staple saddle 72 and are bent or otherwise deformed about innermost sheet 20 to secure staples 80 to sheet stack 74. As such, stapled sheet stack 74 forms bound document 14. Bound document 14 exits second finishing station 124 and is forwarded to an output tray 16 (illustrated in FIG. 1) or another finishing station, such as a trimming station. In one embodiment, finishing system 12 including finishing stations 22 and 24 is controlled by a computer system or processor configured to execute a finishing method per instructions read from a computer readable medium. In one embodiment, the timing of any one or more of operations 102, 104, 106, 108, and 110 may be facilitated by sensors configured to detect the position of sheets 20 with finishing system 12.

Figure 7:
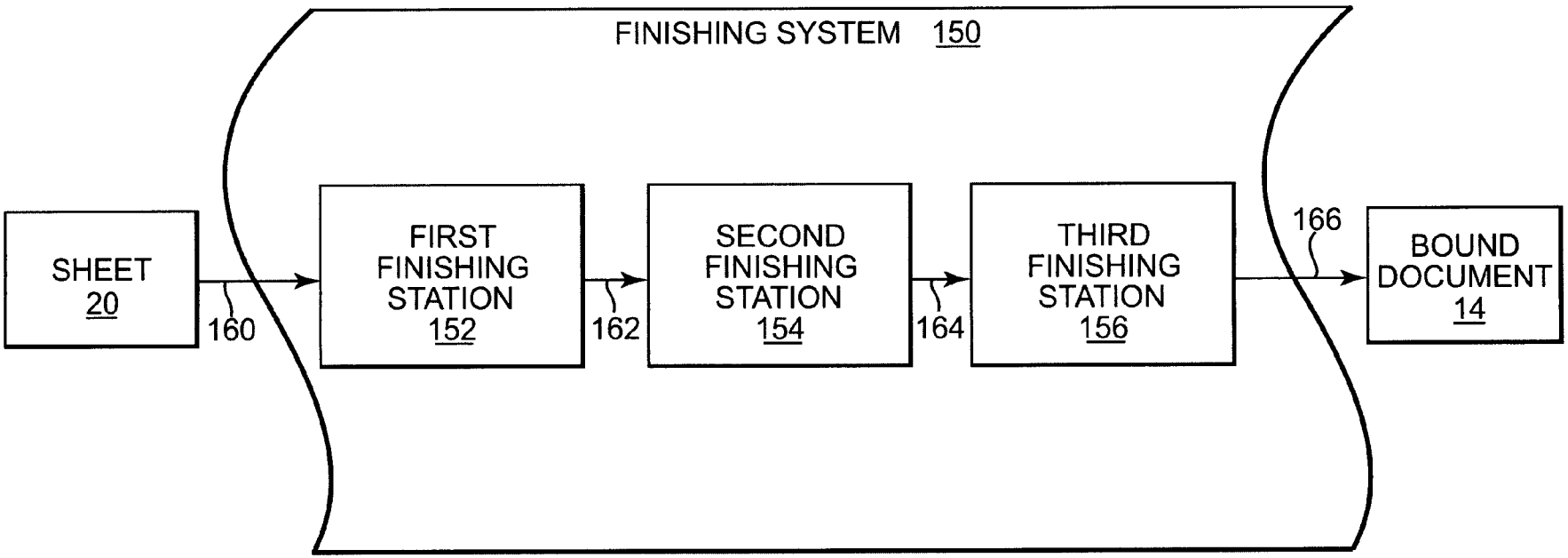
FIG. 7 is a schematic diagram illustrating one embodiment of a portion of the finishing system of FIG. 1 and a media path therethrough.

FIG. 7 illustrates a media flow of sheet 20 through a finishing system 150 similar to finishing system 12. In one embodiment, finishing system 150 includes a first finishing station 152, a second finishing station 154, and the third finishing station 156. In one embodiment, first finishing station 152 is a staple hole punching station, second finishing station 154 is a folding station, and third finishing station 156 is a stapling station. As indicated by arrow 160, sheet 20 is fed to punching station 152, which is configured to punch or otherwise drill or insert staple holes in sheet 20. In one embodiment, punching station 152 includes a punch apparatus similar to punch apparatus 32 or 32' described above and including a pin and a pin receptor being moved toward each other and configured to penetrate each media sheet 20. In one embodiment, punching station 152 does not include a fold blade 34 or other mechanism for folding sheet 20.

Once a hole is punched within individual sheet 20, sheet 20 is forwarded from punching station 152 to folding station 154 as generally indicated by arrow 162. Folding station 154 is configured to fold each sheet 20. In one embodiment, folding station 154 includes a fold blade, a pinch foot, and/or fold rollers similar to those described above with respect to first finishing station 22 (illustrated in FIGS. 2 and 3A) but without punch apparatus 32. As such, each individual sheet is passed through folding station 154 and deformed around a fold blade to fold sheet 20. After folding, sheet 20 is released from folding station 154 and is forwarded to stapling station 156 as generally indicated by arrow 164. Stapling station 156 is similar to second finishing station 24 described above and is configured to accumulate the plurality of sheets 20 on a staple saddle, or other apparatus and to insert staples into staple holes formed by staple hole punching station 152 to bind document 14.

Upon stapling, bound document 14 is forwarded from stapling station 156 to a subsequent finishing station, such as a trimming station, etc., or is otherwise fed to output tray 16 (illustrated in FIG. 1) as generally indicated by arrow 166. In one embodiment, by separating the staple hole punching operation and the folding operation into two separate stations 152 and 154, the overall forces used to finish bound document 14 are further decreased as a single force or set of forces is not used to both punch staple holes within a sheet 20 and to fold sheet 20. Use of other finishing systems, incorporating portions of finishing system 12 and/or finishing system 150 are also contemplated.

Moreover, although primarily described above as staple hole punching and folding sheets 20 in a sheet-wise manner, in other embodiments, portions or fractions of the plurality of sheets 20 to be included in bound document 14 are punched and folded at one time. In particular, a portion of the plurality of sheets 20 including more than one and less than all of sheets 20 is folded and stapled at one time. In this respect, although the forces used to fold and punch each portion of sheets 20 may be greater than the forces used to staple and punch a single sheet 20, the forces are still generally smaller than that would be used to fold and punch all of sheets 20 included in bound document 14 in a single operation. In addition, upon entering any of finishing stations 22, 24, 152, 154, and 156, sheet 20 or the plurality of sheets 20 are generally jogged and/or aligned in any suitable method to facilitate proper placement of fold lines, staple holes, and staples throughout each sheet 20 within the finished bound document 14.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A staple hole forming apparatus configured to facilitate binding a plurality of sheets with a staple having two legs, the staple hole forming apparatus comprising:

a fold blade;

a pair of pins extending from the fold blade and spaced from each other by a distance substantially equal to a distance between the two legs of the staple; and a pin receptor positioned opposite the pair of pins relative to a sheet path through the staple hole forming apparatus, the pin receptor being positioned to mate with at least one of the pair of pins;

wherein one of the pair of pins and the pin receptor is configured to move towards and mate with the other of the pair of pins and the pin receptor causing the pair of pins to penetrate a sheet extending between the pair of pins and the pin receptor to form two holes in the sheet, and further wherein each of the two holes is configured to receive one of the two legs of the staple.

2. The staple hole forming apparatus of claim 1, further comprising a carriage assembly defining the pin receptor and configured to move toward the fold blade.

3. The staple hole forming apparatus of claim 2, wherein movement of the carriage assembly is configured to clamp the sheet between the carriage assembly and the fold blade and to form the two holes in each respective sheet during a single operation.

4. The staple hole forming apparatus of claim 1, further including a pair of rollers configured to press each respective sheet around the fold blade.

5. A staple hole forming apparatus configured to facilitate binding a plurality of sheets with a staple having two legs, the staple hole forming apparatus comprising:

a pair of pins spaced from each other a distance substantially equal to a distance between the two legs of the staple; and a fold blade defining a pin receptor positioned opposite the pair of pins relative to a sheet path through the staple hole forming apparatus, the pin receptor being positioned to mate with at least one of the pair of pins, wherein one of the pair of pins and the pin receptor is configured to move towards and mate with the other of the pair of pins and the pin receptor causing the pair of pins to penetrate a sheet extending between the pair of pins and the pin receptor to form two holes in the sheet, and further wherein each of the two holes is configured to receive one of the two legs of the staple.

6. The staple hole forming apparatus of claim 5, further comprising a carriage assembly including the pair of pins, wherein the carriage assembly is configured to move toward the fold blade causing the pair of pins to mate with the pin receptor.

7. A document binding system for binding a plurality of sheets with a staple having two legs, the document binding system comprising:

a first finishing station including:

a pair of pins spaced from each other a distance substantially equal to a distance between the two legs of the staple, and at least one pin receptor positioned opposite the pair of pins relative to a sheet path through the first finishing station, the at least one pin receptor being positioned to mate with at least one of the pair of pins, wherein one of the pair of pins and the at least one pin receptor are configured to move towards and mate with the other of the pair of pins and the at least one pin receptor to cause the pair of pins to penetrate at least one sheet extending between the pair of pins and the at least one pin receptor to form two holes in the at least one sheet; and a second finishing station positioned downstream from the first finishing station and including a saddle configured to accumulate each of the plurality of sheets from the first finishing station and to position the plurality of sheets on the saddle to align the two staple holes in one of the plurality of sheets with the two staple holes in the others of the plurality of sheets, wherein the second finishing station is configured to insert the two legs of the staple through the two holes formed in the plurality of sheets to bind the plurality of sheets together.

8. The document binding system of claim 7, wherein the second finishing station is configured to place a first leg of the staple through a first staple hole of each of the plurality of sheets, to place a second leg of the staple through a second staple hole in each of the plurality of sheets, and to bend the first and second legs of the staple to bind the plurality of sheets together.

9. A document binding system for binding a plurality of sheets with a staple having two legs, the document binding system, comprising:

a first finishing station including:

a fold blade;

a pair of pins extending from the fold blade and spaced from each other by a distance substantially equal to a distance between the two legs of the staple; and at least one pin receptor positioned opposite the pair of pins relative to a sheet path through the first finishing station, the at least one pin receptor being positioned to mate with at least one of the pair of pins, wherein one of the pair of pins and the at least one pin receptor are configured to move towards and mate with the other of the pair of pins and the at least one pin receptor to cause the pair of pins to penetrate at least one sheet extending between the pair of pins and the at least one pin receptor to form two holes in the at least one sheet; and a second finishing station positioned downstream from the first finishing station and being configured to accumulate the plurality of sheets, the second finishing station configured to insert the two legs of the staple through the two holes formed in the plurality of sheets to bind the plurality of sheets together.

10. The document binding system of claim 9, wherein the first finishing system comprises a carriage assembly defining the at least one pin receptor and being configured to move toward the fold blade.

11. A document binding system for binding a plurality of sheets with a staple having two legs, the document binding system comprising:

a first finishing station including:

a pair of pins spaced from each other a distance substantially equal to a distance between the two legs of the staple, and a fold blade defining at least one pin receptor positioned opposite the pair of pins relative to a sheet path through the first finishing station, the at least one pin receptor being positioned to mate with at least one of the pair of pins, wherein one of the pair of pins and the at least one pin receptor are configured to move towards and mate with the other of the pair of pins and the at least one pin receptor to cause the pair of pins to penetrate at least one sheet extending between the pair of pins and the at least one pin receptor to form two holes in the at least one sheet; and a second finishing station positioned downstream from the first finishing station and being configured to accumulate the plurality of sheets, the second finishing station configured to insert the two legs of the staple through the two holes formed in the plurality of sheets to bind the plurality of sheets together.

12. The document binding system of claim 11, wherein the first finishing station comprises a carriage assembly including the pair of pins, wherein the carriage assembly is configured to move toward the fold blade causing the pair of pins to mate with the at least one pin receptor.

* * * * *